US005643150A

United States Patent [19]

Lee

[11] Patent Number: 5,643,150

[45] Date of Patent: Jul. 1, 1997

[54] FOLDABLE EXERCISER HORSE

[76] Inventor: Kuo-Ron Lee, No. 61, Mei Chou Erh Road, Yi Lan City, Taiwan

[21] Appl. No.: 620,166

[22] Filed: Mar. 22, 1996

[51] Int. Cl.[6] ..... A63B 21/00

[52] U.S. Cl. ..... 482/96; 482/95; 482/76

[58] Field of Search ..... 482/96, 72, 95, 482/73, 94, 97, 133, 51, 57; 472/106, 110; 280/1.182, 1.183, 1.192, 1.203

[56] References Cited

U.S. PATENT DOCUMENTS 5,342,269 8/1994 Huang et al. ..... 482/95
5,356,358 10/1994 Chen ..... 482/96
5,366,428 11/1994 Liao ..... 482/96
5,370,594 12/1994 Grinblat ..... 482/72
5,453,066 9/1995 Richter, Jr. ..... 482/96
5,458,553 10/1995 Wu ..... 482/72

*Primary Examiner*—Jerome Donnelly
*Attorney, Agent, or Firm*—Bacon & Thomas

[57] ABSTRACT

Disclosed is a foldable exerciser horse which has simple and collapsible structure. A user can use it as an exerciser bike while enjoys the fun of riding a horse.

5 Claims, 3 Drawing Sheets

FOLDABLE EXERCISER HORSE

BACKGROUND OF THE INVENTION

There are various types of exerciser bikes available in the market. However, most of these conventional exerciser bikes are bulky and are of complicated structure, and they are not always designed to be foldable. Also, few of these conventional exerciser bikes can provide the fun of riding a horse.

SUMMARY OF THE INVENTION

It is therefore a primary object of the present invention to provide an exerciser horse which has a simple and foldable structure, and can also provide a user with the fun of riding a horse.

The foldable exerciser horse according to the present invention mainly includes two pivotally connected supporting frames, a seat assembly supported on top of the supporting frames, and a handle-bar assembly connected to a top front of the supporting frames. The seat assembly is connected to the handle-bar assembly by means of a link such that pull or push of the handle-bar by a user sitting on the seat will cause the seat assembly to move upward and forward or downward and backward, just as in riding a horse. The foldable exerciser horse provides the user with not only the fun of riding but also the effect of exercise.

DETAILED DESCRIPTION OF THE PREFERRED EMBODIMENTS

Figure 1:
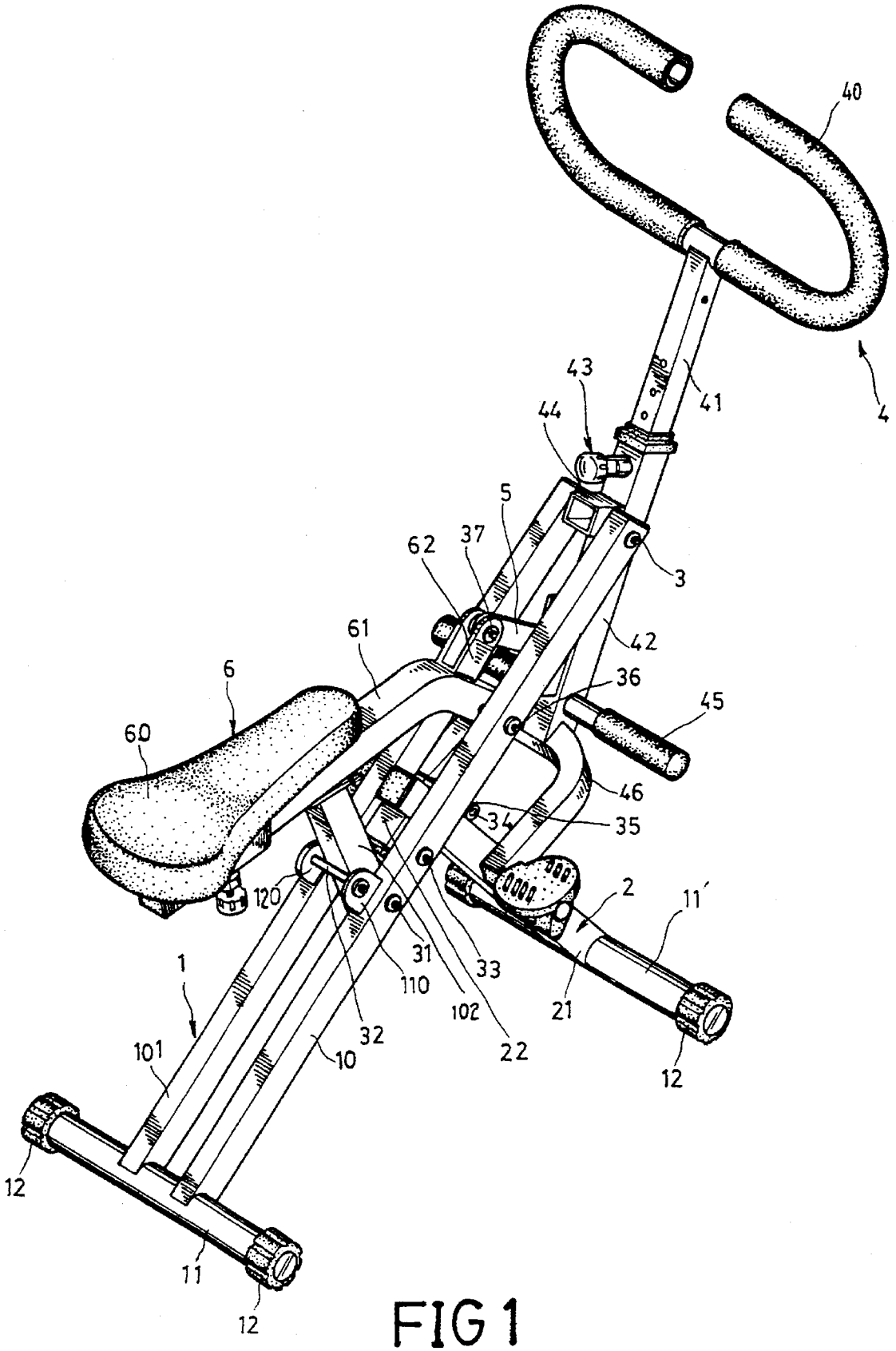
FIG. 1 is an assembled perspective of the present invention.
Figure 2:
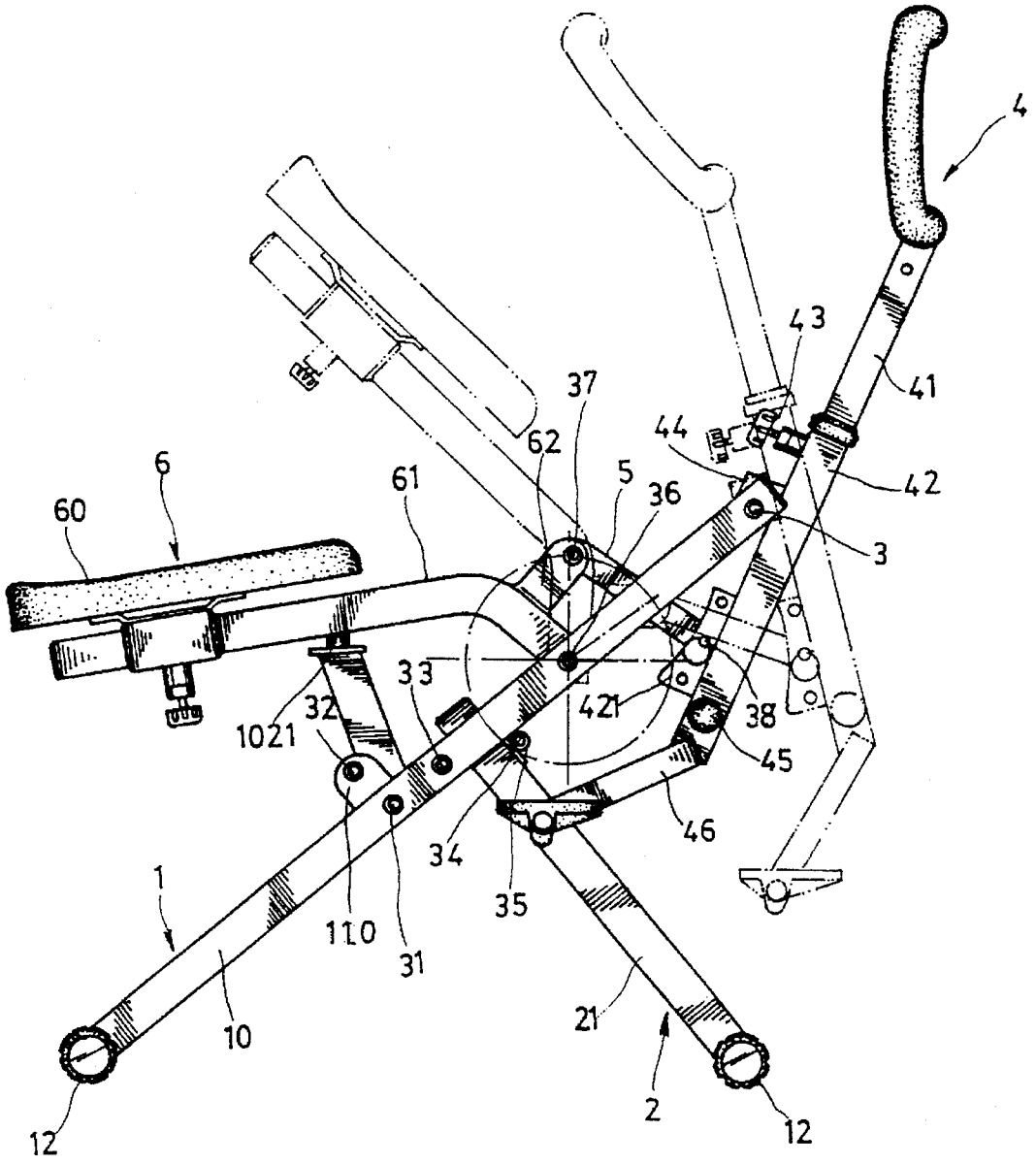
FIG. 2 illustrates the manner in which the seat assembly and the handle-bar assembly view of the present invention are shifted to change their respective positions.

Please refer to FIGS. 1 and 2. The present invention is a foldable exerciser horse including an upper supporting frame 1, a lower supporting frame 2, a handle-bar assembly 4, and a seat assembly 6.

The upper supporting frame 1 includes two parallel members 10, 101. The members 10, 101 are pivotally connected at their top ends to the handle-bar assembly 4 near a middle neck portion thereof by means of a first shaft 3 which serves as a fulcrum so that the handle-bar assembly 4 may be pivotally moved about the shaft 3 relative to the seat assembly 6, and fixedly connected at their lower ends to a transversely extended bar 11 which is positioned on the floor to support the members 10, 101 and has an anti-slip means 12 provided to each end thereof. A pair of lugs 110, 120 are provided on the members 10, 101, respectively, near a top middle portion thereof for a first pin 32 to extend therebetween. A pillar 102 is connected between the members 10, 101 by a second shaft 31, such that when the foldable exerciser horse of the present invention is in an extended state, the pillar 102 just projects upward from and between the members 10, 101 to be stopped by and in front of the pin 32 extending between the lugs 110, 120 to abut against the pin 32. A pad 1021 is attached to a top end of the pillar 102 to receive and support the seat assembly 6. A third shaft 33 extends between the members 10, 101 at a position adequately in front of the second shaft 31 for the lower supporting frame 2 to press against. A cylindrical member 35 with a second pin 34 axially inserted therein is fixed to a bottom side of the members 10, 101 slightly above or in front of the shaft 33. When the upper and the lower supporting frames 1, 2 extend relative to each other, the lower supporting frame 2 shall be stopped by the cylindrical member 35 without further extending forward, so that the lower supporting frame 2 is firmly held between the third shaft 33 and the cylindrical member 35 without shifting. A fourth shaft 36 extends between the members 10, 101 at a position still higher than the cylindrical member 35 and the pin 34 to pivotally connect the seat assembly 6 thereto, serving as a fulcrum for the seat assembly 6 to turn relative to the upper supporting frame 1.

The lower supporting frame 2 includes an upward extended pillar portion 21 extending between the members 10, 101 as well as between the shaft 33 and the cylindrical member 35, and a transversely extended rod 11' connected to a lower end of the pillar portion 21. Anti-slip means 12 are also attached to two ends of the rod 11' for the lower supporting frame 2 to stably position on the floor. The pillar portion 21 has a laterally projected part 22 near a top end thereof so that the part 22 is stopped by and supported on the shaft 33 when the lower supporting frame 2 is extended relative to the upper supporting frame 1, serving as a fulcrum and together with the cylindrical member 35 to enable the lower supporting frame 2 to locate without shifting after it is extended.

The seat assembly 6 includes a top saddle 60 and an arm member 61 having one rear end connected to a bottom side of the top saddle 60 and a downward bent front end pivotally connected to and between the upper supporting frame 1 at a higher position thereof by the fourth shaft 36. The bent front end of the arm member 61 has two lugs 62 projected from a top surface thereof, such that a link 5 is connected to the two lugs 62 by a fifth shaft 37 extending between them. A lower end of the link 5 is then further connected to the handle-bar assembly 4, so that the seat assembly 6 can move along with the shifted handle-bar assembly 4.

The handle-bar assembly 4 mainly includes a handle-bar grip 40, an inner stem 41, and an outer stem 42. The inner stem 41 can be slidably received within the outer stem 42, and be fixed relative to the outer stem 42 at a desired extended length with a locating bolt 43 provided near a top end of the outer stem 42. A laterally projected part 44 projects from near the top of the outer stem 42 into and between the top ends of the members 10, 101 and be pivotally connected thereto by means of the first shaft 3. Two connecting plates 421 are provided to the outer stem 42 at a position lower than the projected part 44, such that the link 5 is pivotally connected at its lower end to and between the two connecting plates 421 by means of a third pin 38. Whereby, the backward or forward movement of the stems 41, 42 actuated by a user shall cause the seat assembly 6 to shift forward or backward at the same time via the link 5 connected between the two assemblies 4 and 6. The handle-bar grip 40 has two curved ends which are comfortably gripped by the user. A pair of foot-rests 45 and a pair of pedals 46 are provided near and at a lower end of the outer stem 42, respectively, forming two angularly different positions for resting the user's feet.

The use of the foldable exerciser horse of the present invention is illustrated in FIG. 2. The user (not shown) is seated on the top saddle 60 with his or her feet positioned on the foot-rests 45 or the pedals 46 and hands gripping the handle-bar grip 40. When the handle-bar grip 40 is pulled back toward the user, the seat assembly 6 is brought to turn upward about the fifth shaft 37 relative to the upper supporting frame 1, just as in riding a horse.

Figure 3:
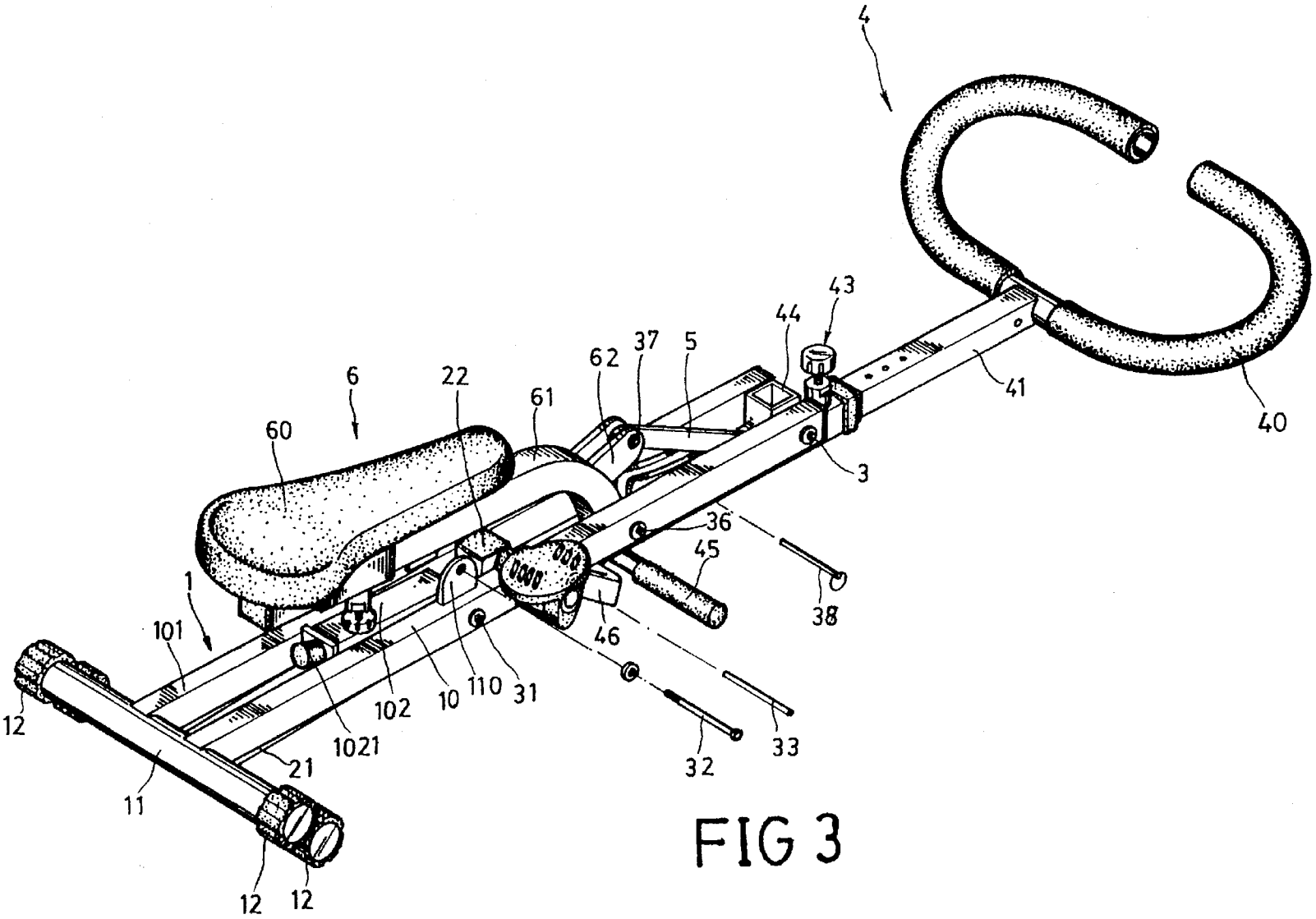
FIG. 3 illustrates the present invention in a folded state.

To fold the exerciser horse of the present invention for storage when it is not in use, simply remove the pins 32, 34, and 38 from their original positions, and the whole exerciser horse can be collapsed to a reduced volume, as shown in FIG. 3, for convenient storage.

What is claimed is:

1. A foldable exerciser horse comprising:

a) an upper supporting frame, a lower supporting frame, a seat assembly and a handle bar assembly;

b) the upper supporting frame including two parallel members having a pair of top ends and a pair of lower ends, a first shaft pivotally connecting the top ends to a middle neck portion of the handle bar assembly for permitting the handle bar assembly to pivot about the first shaft relative to the upper supporting frame, a pair of lugs on a top middle portion of the parallel members, a first pin extending between the lugs, a first pillar having a first end and a second end, a second shaft pivotally connecting the first end of the first pillar between the parallel members, whereby when the exerciser horse is disposed in an extended position, the first pillar projects upwardly from between the parallel members and engages the first pin;

c) the lower supporting frame including an upwardly extending second pillar having an upper end and a lower end, a transversely extending rod connected to the lower end of the second pillar, and means secured to the rod for supporting the lower supporting frame in a stable position on a floor;

d) the seat assembly including a top saddle, an arm member having a downwardly bent front end, a pair of lugs projecting outwardly from a top surface of the bent front end, a link having a first end and a second end, a third shaft pivotally connecting the first end of the link between the two lugs, the second end of the link being pivotally connected to the handle bar assembly, thereby permitting the seat assembly to be moved during movement of the handle bar assembly; and e) the handle bar assembly including an outer stem, an inner stem slidably received within the outer stem, and a locating bolt positioned adjacent a top end of the outer stem for securing the position of the inner stem relative to the outer stem.

2. The foldable exerciser horse of claim 1 wherein the second end of the first pillar includes a pad engageable by the arm member when the exerciser horse is in the extended position.

3. The foldable exerciser horse of claim 1 further including a fourth shaft extending between the two parallel members of the upper supporting frame, the fourth shaft being disposed in a higher position than the second shaft for engagement by the second end of the second pillar when the exerciser horse is in the extended position.

4. The foldable exerciser horse of claim 1 further including a cylindrical member secured to a bottom side of the two parallel members, the cylindrical member being positioned above the fourth shaft when the exerciser horse is in the extended position, a second pin disposed within the cylindrical member, whereby when the upper and lower supporting frames extend relative to each other to dispose the exerciser horse in the extended position, the cylindrical member is engaged by the second pillar to restrict the forward movement of the second pillar and permit the second pillar to be securely maintained between the fourth shaft and the cylindrical member.

5. The foldable exerciser horse of claim 4 further including a fifth shaft extending between the two parallel members for pivotally connecting the bent front end of the arm member to the upper supporting frame, and the fifth shaft being disposed at a higher position than that of the cylindrical member when the exerciser horse is in the extended position, and a third pin pivotally connecting the second end of the link to the handle bar assembly, whereby removal of the first, second and third pins permit the lower supporting frame to be folded under the upper supporting frame, the arm member of the seat assembly to be folded onto the upper supporting frame and the handle bar assembly to be folded under the upper supporting frame for disposing the exerciser horse in a collapsed position.

* * * * *